US007409170B2

(12) United States Patent
Mizuta

(10) Patent No.: US 7,409,170 B2
(45) Date of Patent: Aug. 5, 2008

(54) DEVELOPING APPARATUS, IMAGE FORMING APPARATUS AND DENSITY DETECTION METHOD

(75) Inventor: Katsunori Mizuta, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 288 days.

(21) Appl. No.: 11/387,281

(22) Filed: Mar. 23, 2006

(65) Prior Publication Data

US 2007/0223944 A1 Sep. 27, 2007

(51) Int. Cl.
*G03G 15/08* (2006.01)

(52) U.S. Cl. ..... 399/27; 399/30; 399/61; 399/62; 399/111; 399/120

(58) Field of Classification Search ..... 399/25, 399/27, 29, 30, 61, 62, 111, 120
See application file for complete search history.

(56) References Cited

U.S. PATENT DOCUMENTS 5,530,530 A * 6/1996 Tanaka et al. ..... 399/64
5,826,134 A * 10/1998 Hino et al. ..... 399/27
6,104,892 A * 8/2000 Kobayashi et al. ..... 399/63
6,345,163 B1 * 2/2002 Suzuki et al. ..... 399/61
6,381,419 B1 * 4/2002 Kinoshita et al. ..... 399/27

FOREIGN PATENT DOCUMENTS

JP 2000-122399 4/2000
JP 2002-148927 5/2002

* cited by examiner

*Primary Examiner*—Hoan H Tran
(74) *Attorney, Agent, or Firm*—Amin, Turocy & Calvin, LLP

(57) ABSTRACT

To provide a technology capable of realizing high-accuracy detection of toner density.

A developing apparatus includes: a partition plate provided within the developing apparatus for partitioning an interior of the developing apparatus into a plurality of space; plural transport mixers each provided in the space within the developing apparatus partitioned by the partition plate and rotating for stirring and transporting a developer including toner and carrier; a density sensor provided in a transport path of the developer in one space of the plurality of space partitioned by the partition plate for detecting toner density of the stirred and transported developer; and retracting part for retracting an amount of the developer more than a predetermined amount into another space than the space in which the toner density is detected by the density sensor so that the amount of developer is constantly equal to or less than the predetermined amount near a toner density detection position by the density sensor.

19 Claims, 10 Drawing Sheets

DEVELOPING APPARATUS, IMAGE FORMING APPARATUS AND DENSITY DETECTION METHOD

BACKGROUND OF THE INVENTION

1. Field of the Invention

The present invention relates to an image forming apparatus using electrophotography such as a copier, a printer, a facsimile, and a complex machine thereof, and specifically, to a density detection technology of detecting density of a developer by density detecting means provided in a transport path of the developer in a developing apparatus using a two-component developer.

2. Description of the Related Art

Conventionally, a two-component image forming apparatus for forming images using a developer containing toner and carrier is arranged so as to form an electrostatic latent image on a photoconductor drum as an image carrier, develop the electrostatic latent image with a developing apparatus, transfer the obtained toner image onto paper by a transfer unit, and fix the image to the paper by a fixing unit. At the same time, an amount of toner in the developing apparatus is always kept constant by sensing the used amount of toner by detecting the toner ratio density (a ratio of an amount of toner in a developer) as developer density with a sensor and supplying toner from a toner bottle into the developing apparatus according to the sensed amount of toner.

As shown in FIG. 14, as a conventional developing apparatus, one provided with a pair of transport mixers 300 and 302 for oppositely transporting a developer along a longitudinal direction, a partition plate 304 that partitions between these pair of transport mixers 300 and 302, a density sensor 306 for detecting the toner ratio density at the time of development on the undersurface of developing apparatus in a development position has been known (e.g., JP-A-2000-122399).

Since the density sensor 306 provides different output voltages depending on variations in bulk of the developer on the density sensor 306 even for the same toner ratio density, a detection error in toner ratio density is caused.

In addition, since a certain amount of developer is required on the density sensor 306 to detect the toner ratio density by the density sensor 306 in the apparatus shown in FIG. 14, a paddle 302*b* for delaying the transport of the developer is formed in a position facing the density sensor 306 on the transport mixer 302. Further, since the height of the partition plate 304 for partitioning between the transport mixers 300 and 302 is constant, when the toner ratio density in the developer rises and the bulk of the developer increases, the developer is deposited especially on the density sensor 306 by the action of the paddle 302*b* and the bulk density of the developer on the density sensor 306 becomes higher. The condition is shown in FIG. 15. The rise of toner ratio density and the output of the density sensor 306 are proportional to each other to a certain point (to a value of toner ratio density of about 8.3 wt % in FIG. 15), however, a phenomenon that the output of the density sensor 306 reverses relative to the toner ratio density at the above point when the bulk density becomes extremely high occurs. Accordingly, although the actual toner ratio density is high, the toner ratio density output by the density sensor 306 becomes lower, and thereby, toner is supplied into the developing apparatus more than necessary.

As a technology for solving such a problem, one that prevents rising of the bulk of the developer on the density sensor by reducing the height of the partition plate at the upstream of the density sensor lower than the other part and has a part of the rotational shaft of the transport mixer facing the density sensor made larger in diameter than the other part has been disclosed (e.g., JP-A-2002-148927).

A relationship between the toner ratio density and the sensor output in this case is shown in FIG. 15. Although the toner ratio density at which the sensitivity of the density sensor is reversed is slightly higher than that shown in FIG. 15, a reversal phenomenon also occurs in the sensor output. In the structure, fins are formed on the periphery of the rotational shaft of the transport mixer in order to stir and transport the developer, and the rotational shaft of the transport mixer on the density sensor has a larger diameter than that of the other part and the size of the fins of this part is smaller than that of the other part. Accordingly, the transport speed of the developer on the density sensor becomes extremely slow, and, even when the height position of the partition plate at the upstream of the density sensor is lowered, consequently, a phenomenon that a large amount of developer collects on the density sensor and the bulk density becomes higher occurs. Further, there is another problem that image smudges are produced because the transport path of the developer becomes shorter as the height position of the partition plate at the upstream of the density sensor is lowered than that of the other part, and the developer is transported to the developing sleeve side from the lowered partition plate before fresh toner replenished from the replenishment port is mixed with the developer.

SUMMERY OF THE INVENTION

The invention has been achieved in order to solve the above described problems, and a purpose thereof is to provide a technology capable of realizing high-accuracy detection of toner ratio density.

In order to solve the above described problems, a developing apparatus according to one aspect of the invention includes: a partition member provided within the developing apparatus for partitioning an interior of the developing apparatus into a plurality of space; a transport member each provided in the space within the developing apparatus partitioned by the partition member and rotating for stirring and transporting a developer including toner and carrier; a density detector provided in a transport path of the developer in one space of the plurality of space partitioned by the partition member for detecting density of the stirred and transported developer; and a retraction part for retracting an amount of the developer more than a predetermined amount into another space than the space in which the density is detected by the density detector so that the amount of developer is constantly equal to or less than the predetermined amount near a density detection position by the density detector.

In order to solve the above described problems, a developing apparatus according to one aspect of the invention includes: a partition member provided within the developing apparatus for partitioning an interior of the developing apparatus into a plurality of space; a transport member each provided in the space within the developing apparatus partitioned by the partition member and rotating for stirring and transporting a developer including toner and carrier; a density detector provided in a transport path of the developer in one space of the plurality of space partitioned by the partition member for detecting density of the stirred and transported developer; and a retraction part being a space part as retraction space provided in a position overlapping at least part of the density detector in a transport direction of the developer in the space in which the density is detected by the density detector and having larger volume than the other part.

In order to solve the above described problems, a developing apparatus according to one aspect of the invention includes: partitioning means for partitioning an interior of the developing apparatus into a plurality of space; transporting means for stirring and transporting a developer including toner and carrier in the space; density detecting means for detecting density of the developer in one space of the plurality of space; and retracting means for retracting an amount of the developer more than a predetermined amount into another space than the space in which the density is detected by the density detector so that the amount of developer is constantly equal to or less than the predetermined amount near a density detection position by the density detector.

In order to solve the above described problems, a developing apparatus according to one aspect of the invention includes: partitioning means for partitioning an interior of the developing apparatus into a plurality of space; transporting means for stirring and transporting a developer including toner and carrier in the space; density detecting means for detecting density of the developer in one space of the plurality of space; and retracting means being a space part as retraction space provided in a position overlapping at least part of the density detector in a transport direction of the developer in the space in which the density is detected by the density detector and having larger volume than the other part.

In order to solve the above described problems, a developing density detection method according to one aspect of the invention is a density detection method that stirs and transports a developer including toner and carrier by rotation of plural transport members respectively provided in a plurality of space formed by partitioning an interior of a developing apparatus with a partition member and detecting density of the stirred and transported developer by a density detector, and the method includes: a transporting step that transports the developer at least in one space of the plurality of space partitioned by the partition member; a retracting step that retracts an amount of the developer more than a predetermined amount into another space than the space in which the density is detected by the density detector so that the amount of developer is constantly equal to or less than the predetermined amount near a density detection position by the density detector; and a toner density detecting step that detects the density of the developer maintained in the predetermined amount near the density detection position by the retracting step.

In order to solve the above described problems, a developing density detection method according to one aspect of the invention is a density detection method that stirs and transports a developer including toner and carrier by rotation of plural transport members respectively provided in a plurality of space formed by partitioning an interior of a developing apparatus with a partition member and detecting density of the stirred and transported developer by a density detector, and the method includes: a transporting step that transports the developer at least in one space of the plurality of space partitioned by the partition member; a retracting step that retracts the developer into a space part as retraction space provided in a position overlapping at least part of the density detector in a transport direction of the developer in the space in which the density is detected by the density detector and having larger volume than the other part; and a toner density detecting step that detects the density of the developer maintained in the predetermined amount near the density detection position by the retracting step.

DESCRIPTION OF THE DRAWINGS

FIG. 11(*b*) is a perspective view of the process cartridge.

DESCRIPTION OF THE EMBODIMENTS

Figure 1:
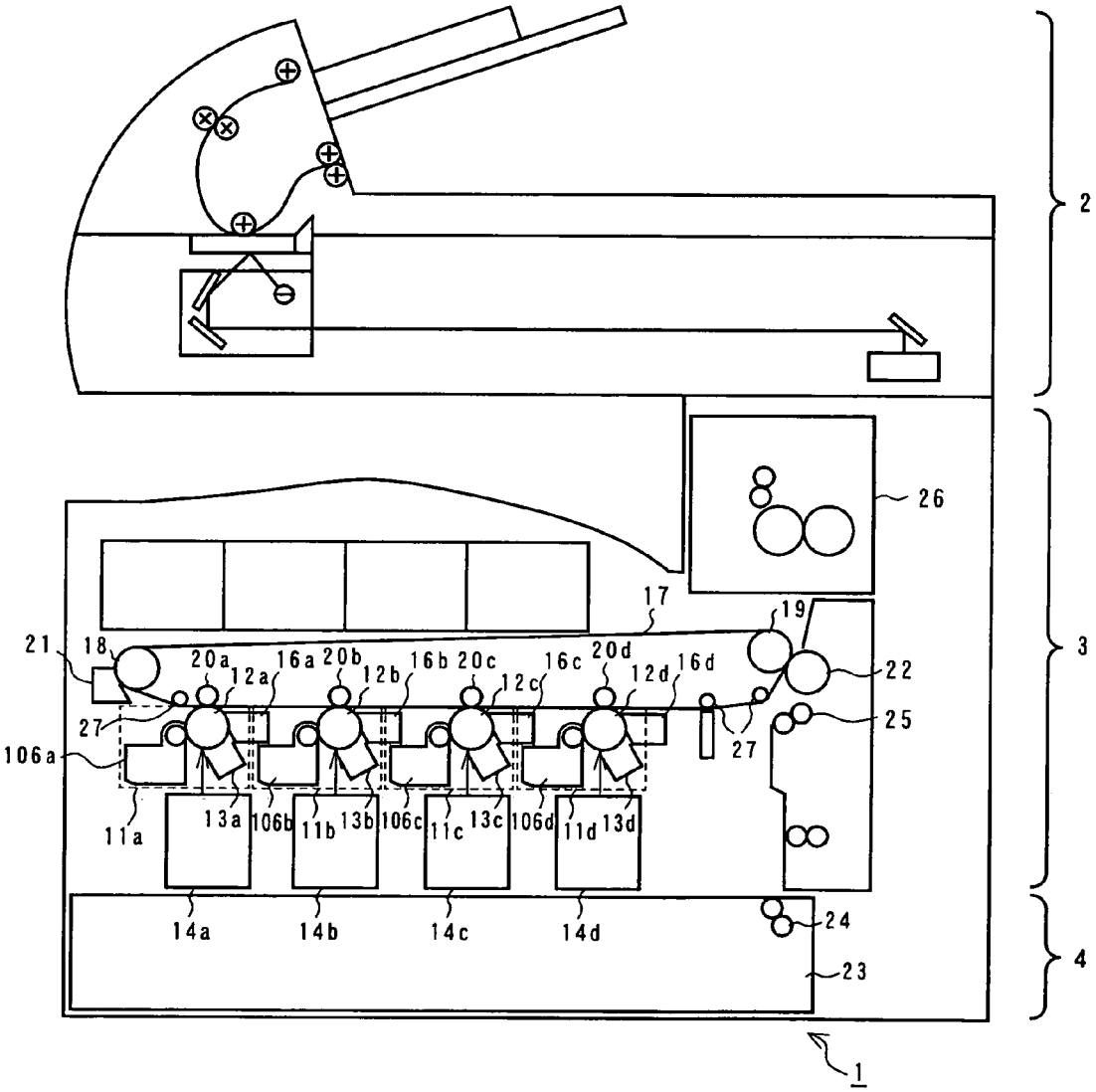
FIG. 1 is a sectional view showing a schematic mechanical configuration of a section of an image forming apparatus according to the first embodiment of the invention.

Hereinafter, embodiments of the invention will be described by referring to the drawings.

First Embodiment

Figure 2:
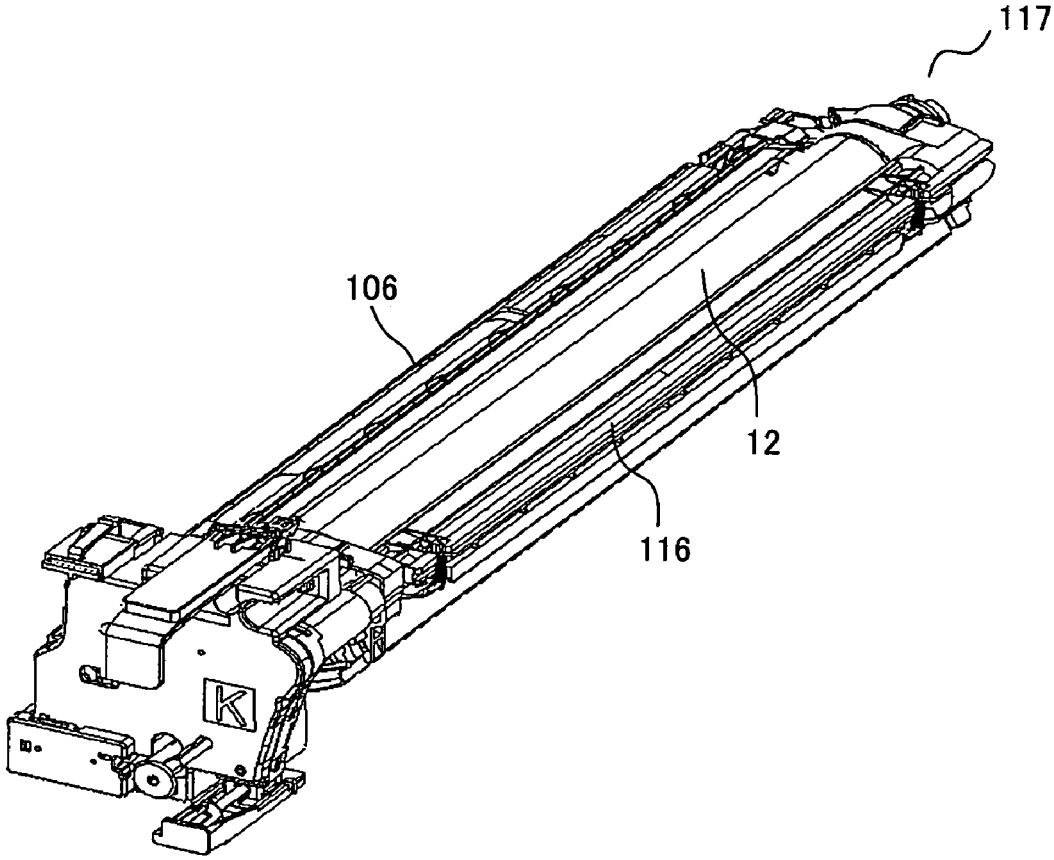
FIG. 2 is a perspective view of a process cartridge.
Figure 3:
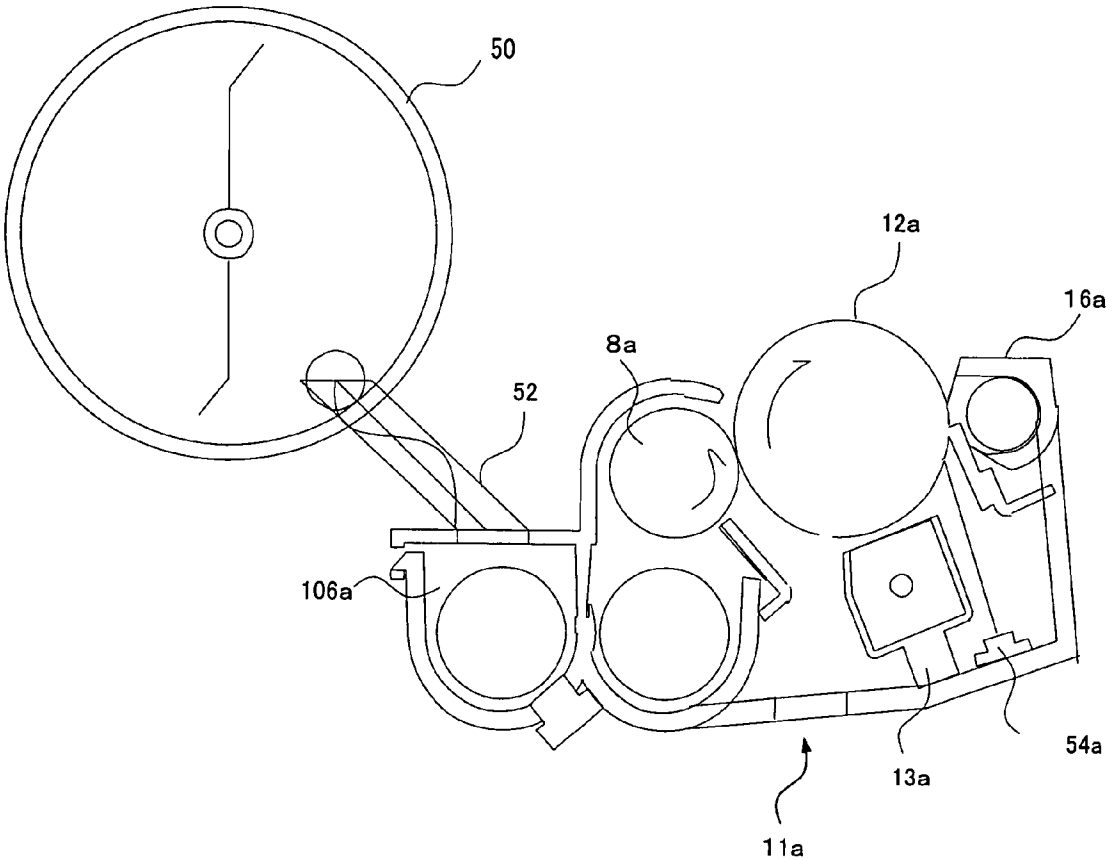
FIG. 3 is a schematic sectional view of the process cartridge and a toner cartridge.

FIG. 1 is a sectional view showing a schematic mechanical configuration of a section of an image forming apparatus according to the first embodiment of the invention, FIG. 2 is a perspective view of a process cartridge including the image forming apparatus according to the embodiment, and FIG. 3 is a sectional view showing a configuration around the process cartridge.

As shown in FIG. 1, an image forming apparatus 1 includes a scanner part 2, an image forming part 3, and a paper feed part 4.

The scanner part 2 irradiates an original set on a platen with light, guides the reflected light from the original to light receiving elements via plural optical members, performs photoelectric conversion thereon, and supplies image signals to the image forming part 3.

Process cartridges 11*a*, 11*b*, 11*c*, and 11*d* are provided in the image forming part 3, and the respective process cartridges have photoconductor drums 12*a*, 12*b*, 12*c*, and 12*d*, respectively, as image carriers, and form images of developer on these photoconductor drums.

In FIG. 3, the photoconductor drum 12*a* has a cylindrical shape of 30 mm in diameter, for example, and is provided rotatably in a direction of an arrow in the drawing. As a photoconductor, not only the drum but also a belt may be used.

Around the photoconductor drum 12*a*, devices pertaining thereto are provided along a rotational direction. First, a charging charger 13*a* is provided facing the surface of the photoconductor drum 12*a*, and the charging charger 13*a* uniformly and negatively (−) charges the photoconductor drum 12*a*. As a charging charger, not only corona wires but also a roller or brush in contact with the photoconductor drum may be used.

At the downstream of the charging charger 13*a*, an exposure device 14*a* for exposing the charged photoconductor drum 12*a* to light to form an electrostatic latent image is provided, and the exposure device 14*a* exposes the photoconductor drum 12*a* to a laser beam optically modulated in response to an image signal supplied from the scanner part 2. The exposure device 14*a* may use an LED (Light Emitting Diode) in place of the laser beam.

Further, at the downstream of the exposure device 14*a*, a developing apparatus 106*a* that accommodates a developer of yellow and performs reversal development of the electrostatic latent image formed by the exposure device 14*a* with the developer is provided. In the developing apparatus 106*a*, a developing roller 8*a* (developing means) for visualizing the electrostatic latent image by supplying the developer to the photoconductive surface of the photoconductor drum 12*a* carrying the electrostatic latent image is provided.

An intermediate transfer belt 17 as an image formed medium is provided in contact with the photoconductor drum 12*a*. As an intermediate transfer belt, not only the belt but also a drum may be used.

A cleaner 16*a* is provided at the downstream side of the contact position between the photoconductor drum 12*a* and the intermediate transfer belt 17. The cleaner 16*a* removes and collects residual toner on the photoconductor after transfer. As a cleaner, not only a blade but also a brush may be used.

A static elimination lamp 54*a* eliminates surface charge of the photoconductor drum 12*a* with uniform light irradiation. As a static eliminator, not only the lamp but also a corona charger may be used.

Thereby, one cycle of image formation is completed, and, in the next image formation process, the charging charger 13*a* uniformly charges the uncharged photoconductor drum 12*a* again.

As shown in FIGS. 2 and 3, the process cartridge 11*a* is formed integrally by the photoconductor drum 12*a*, the charging charger 13*a*, the developing apparatus 106*a*, and the cleaner 16*a* as a cartridge, and detachable from the apparatus main body. Further, a toner cartridge 50 accommodating fresh toner is connected to the developing apparatus 106*a* via an auger 52, and thereby, the fresh toner is supplied to the developing apparatus 106*a*. The toner cartridge 50 is detachably provided to the image forming apparatus 1.

The intermediate transfer belt 17 has a length (width) nearly equal to the longitudinal dimension of the photoconductor drum 12*a* in a direction (in the depth direction of the drawing) perpendicular to the transport direction (a direction of arrow e in the drawing). The intermediate transfer belt 17 has a shape of endless (seamless) belt, and is wrapped around a driving roller 18 that rotates the belt at a predetermined speed and a secondary transfer opposing roller 19 as a driven roller and carried. The sign 27 denotes a tension roller for holding the intermediate transfer belt 17 at constant tension.

Further, the intermediate transfer belt 17 is formed by polyimide having a thickness of 100 μm in which carbon has been uniformly dispersed, and the intermediate transfer belt 17 has electric resistance of $10^{-9}$ Ωcm and exhibits semiconductivity.

As a material of the intermediate transfer belt 17, a material exhibiting semiconductivity with volume resistance value from $10^{-8}$ to $10^{-11}$ Ωcm may be used. For example, not only polyimide with carbon dispersed but also polyethylene terephthalate, polycarbonate, polytetrafluoroethylene, polyvinylidene fluoride, etc. with conductive particles such as carbon dispersed may be used. A polymer film with electric resistance adjusted by composition adjustment may be used without using conductive particles. Furthermore, a material formed by mixing an ionic conductive material in such a polymer film, or a rubber material such as silicon rubber and urethane rubber having relatively low electric resistance may be used.

Further, on the intermediate transfer belt 17, not only the process cartridge 11*a* but also the process cartridges 11*b*, 11*c*, and 11*d* are provided between the driving roller 18 and the secondary transfer opposing roller 19 along the transport direction of the intermediate transfer belt 17, and all of the respective process cartridges 11*b*, 11*c*, and 11*d* have the same configuration as that of the process cartridge 11*a*.

That is, the photoconductor drums 12*b*, 12*c*, and 12*d* are provided nearly at the center of the respective process cartridges, and charging chargers 13*b*, 13*c*, and 13*d* are respectively provided facing the surfaces of the respective photoconductor drums 12*b*, 12*c*, and 12*d*. At the downstream of the respective charging chargers, exposure devices 14*b*, 14*c*, and 14*d* for exposing the charged photoconductor drums 12*b*, 12*c*, and 12*d* to light to form electrostatic latent images are respectively provided, and, at the downstream of the exposure devices 14*b*, 14*c*, and 14*d*, developing apparatuses 106*b*, 106*c*, and 106*d* for performing reversal development of the electrostatic latent images formed by the exposure devices 14*b*, 14*c*, and 14*d* are respectively provided. Further, cleaners 16*b*, 16*c*, and 16*d* are provided at the downstream side of the contact positions between the photoconductor drums 12*b*, 12*c*, and 12*d* and the intermediate transfer belt 17, and the developing apparatuses 106*b*, 106*c*, and 106*d* accommodate magenta developer, cyan developer, and black developer, respectively.

The intermediate transfer belt 17 sequentially contacts the respective photoconductor drums 12*a* to 12*d*. In the vicinities of the contact positions of the intermediate transfer belt 17 and the respective photoconductor drums, primary transfer rollers 20*a*, 20*b*, 20*c*, and 20*d* are provided correspondingly to the respective photoconductor drums. That is, the primary transfer rollers 20*a* to 20*d* are provided in contact with the intermediate transfer belt 17 at the rear side above the corresponding photoconductor drums, and opposed to the process cartridges 11*a* to 11*d* via the intermediate transfer belt 17. The primary transfer members 20*a* to 20*d* are connected to a positive (+) direct-current power supply (not shown) as voltage applying means.

Further, in the vicinity of the driving roller 18, an intermediate transfer belt cleaner 21 for removing residual toner on the intermediate transfer belt 17 is provided.

On the other hand, below the image forming part 3 in FIG. 1, a paper feed cassette 23 of the paper feed part 4 accommodating paper is provided, and a pickup roller 24 for picking up paper one by one from the paper feed cassette 23 is provided in the paper feed part 4.

Near a secondary transfer roller 22 of the image forming part 3, a pair of resist rollers 25 are rotatably provided, and the pair of resist rollers 25 supply paper to a secondary transfer part in which the secondary transfer roller 22 and the secondary transfer opposing roller 19 face each other with the intermediate transfer belt 17 in between.

Further, in FIG. 1, above the intermediate transfer belt 17, a fixing unit 26 for fixing the developer on the paper is provided, and the fixing unit 26 applies predetermined heat and pressure to the paper holding a toner image and fixes the fused toner image to the paper.

Note that, since the respective process cartridges 11*a* to lid have the same configuration, they are generally named as a process cartridge 11 as below in the case where there is no need to distinguish them. Further, the respective parts provided in the process cartridge 11 are similarly named.

Color image formation operation of the image forming apparatus 1 configured as described above will be described.

When the start of image formation is instructed (that is, when an instruction to start printing is given), the photoconductor drum 12*a* receives a driving force from a driving mechanism (not shown) and starts rotating. The charging charger 13*a* uniformly charges the photoconductor drum 12*a* to about −600 V. An exposure device 7*a* irradiates the photoconductor drum 12*a* uniformly charged by the charging charger 13*a* with light according to an image to be printed and forms an electrostatic latent image. The developing apparatus 106*a* accommodates a developer (yellow (Y) toner+ferrite carrier: two-component developer), provides a bias value of −380 V to the developing sleeve (not shown) by a developing bias supply (not shown), and forms a developing field between the photoconductor drum 12*a* and itself. This is reversal development that the negatively charged Y-toner attaches an area of the image part potential (high potential part: consider the sign) of the electrostatic latent image of the photoconductor 12*a*.

Then, the developing apparatus 106*b* develops an electrostatic latent image with a magenta developer, and forms a magenta toner (M-toner) image on the photoconductor drum 12*b*. In this regard, the M-toner has an average particle diameter on the order of several microns (e.g., seven microns) similarly to the Y-toner, and is negatively charged by frictional charge with ferrite magnetic carrier particles (not shown) having an average particle diameter of about 60 microns. The developing bias value is about −380 V as is the case of the developing apparatus 106*a*, for example, and applied to a development sleeve (the developing apparatus structure is the same as that of the developing apparatus 106*a*) by a bias supply (not shown). The direction of the developing field is from the photoconductor drum 12*b* surface toward the developing sleeve in the image part, and the negatively charged M-toner attaches to the high potential part of the latent image.

The developing apparatus 106*c* develops an electrostatic latent image with a cyan developer, and forms a cyan toner (C-toner) image on the photoconductor drum 12*c*. In this regard, the C-toner has an average particle diameter on the order of several microns (e.g., seven microns) similarly to the Y-toner, and is negatively charged by frictional charge with ferrite magnetic carrier particles (not shown) having an average particle diameter of several tens of microns (about 60 microns). The developing bias value is about −380 V as is the case of the developing apparatus 106*a*, for example, and applied to a development sleeve (the developing apparatus structure is the same as that of the developing apparatus 106*a*) by a bias supply (not shown). The direction of the developing field is from the photoconductor drum 12*c* surface toward the developing sleeve in the image part, and the negatively charged C-toner attaches to the high potential part of the latent image.

The developing apparatus 106*d* develops an electrostatic latent image with a black developer, and forms a black toner (B-toner) image on the photoconductor drum 12*d*. In this regard, the B-toner has an average particle diameter on the order of several microns (e.g., seven microns) similarly to the Y-toner, and is negatively charged by frictional charge with ferrite magnetic carrier particles (not shown) having an average particle diameter of several tens of microns (about 60 microns) The developing bias value is about −380 V as is the case of the developing apparatus 106*a*, for example, and applied to a development sleeve (the developing apparatus structure is the same as that of the developing apparatus 106*a*) by a bias supply (not shown). The direction of the developing field is from the photoconductor drum 12*d* surface toward the developing sleeve in the image part, and the negatively charged B-toner attaches to the high potential part of the latent image.

In transfer area Ta formed by the photoconductor drum 12*a*, the intermediate transfer belt 17, and the primary transfer roller 20*a*, a required voltage such as a bias voltage of about 1000V, for example, is applied to the primary transfer roller 20*a*. A transfer field is formed between the primary transfer roller 20*a* and the photoconductor drum 12*a*, and the Y-toner image on the photoconductor drum 12*a* is transferred onto the intermediate transfer belt 17 according to the transfer field.

The configurations of the primary transfer rollers 20*b*, 20*c*, and 20*d* are basically the same as that of the primary transfer roller 20*a*, and the description thereof will be omitted for avoiding repetition.

Thus, the magenta developer image, the cyan developer image, and the black developer image are sequentially multiple-transferred on the Y-toner developer image. On the other hand, the pickup roller 24 takes paper from the paper feed cassette 23, and the pair of resist rollers 25 supply the paper to the secondary transfer part.

In the secondary transfer part, the secondary transfer opposing roller 19 is applied with a required bias to form the transfer field between the secondary transfer roller 22 and itself with the intermediate transfer belt 17 in between, and the multiple color toner image on the intermediate transfer belt 17 is transferred by one operation onto the paper. Thus, the developer images of the respective colors transferred by one operation are fixed to the paper by the fixing unit 26 to form a color image. The fixed paper is ejected onto a paper ejection part (not shown).

Figure 4:
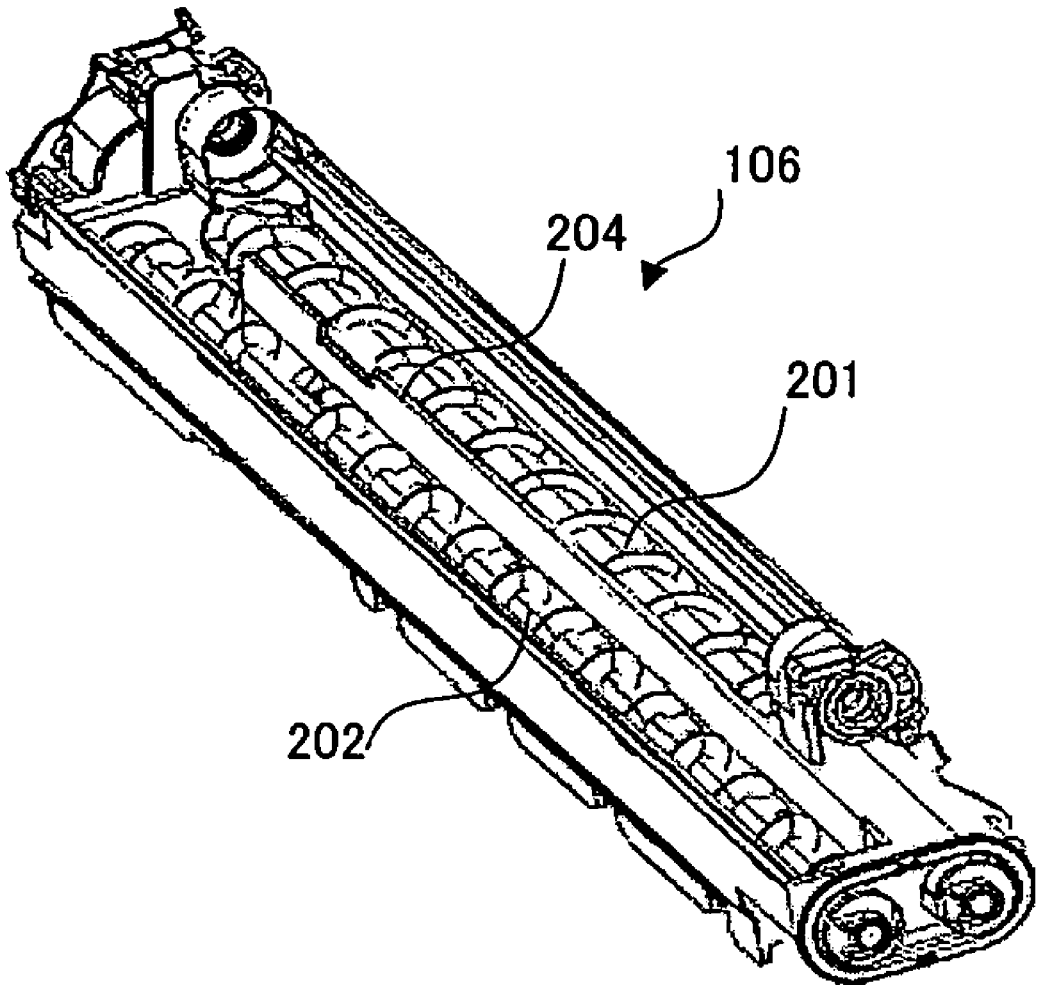
FIG. 4 is a perspective view showing a developing apparatus of the first embodiment.
Figure 5:
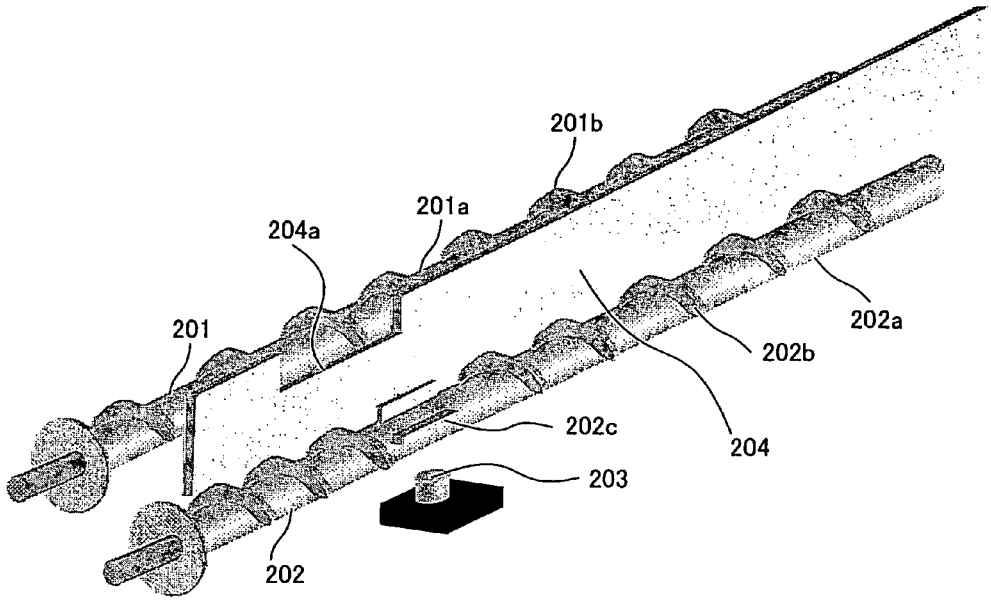
FIG. 5 is a perspective view of the part of transport mixers, a partition plate, and a density sensor of the first embodiment.
Figure 6:
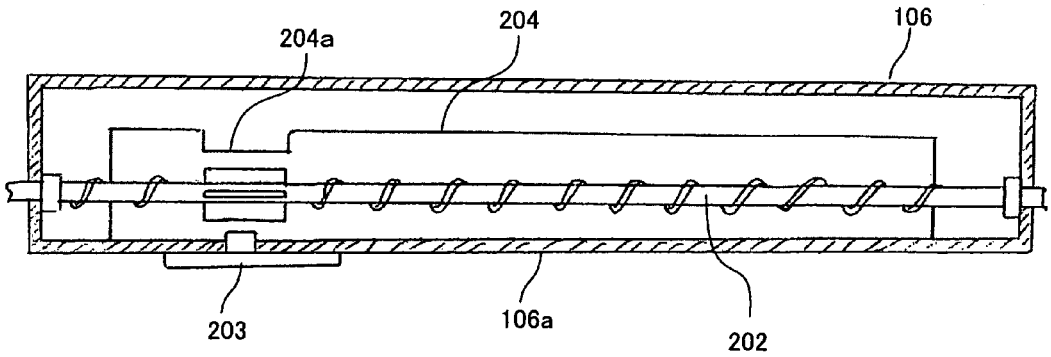
FIG. 6 is a sectional view showing the interior of the developing apparatus of the first embodiment at the side where the density sensor is provided.

FIG. 4 illustrates a perspective view showing the first embodiment of the developing apparatus 106 of the embodiment, FIG. 5 illustrates a perspective view showing the part of transport mixers (transport members) 201 and 202, a partition plate (partition member) 204, and a density sensor (density detector) 203, and FIG. 6 illustrates a sectional view showing the interior of the developing apparatus 106 at the side where the density sensor 203 is provided, respectively.

The developing apparatus 106 includes the developing roller (not shown), the two transport mixers 201 and 202, the density sensor 203, and the partition plate 204, and the developing roller transports a developer to the photoconductor drum 12.

The two transport mixers 201 and 202 are respectively provided in parallel to the developing roller shaft, and supply the developer to the developing roller while rotating to circulate the developer (transporting step) and stir the toner and carrier for charging. The transport mixer 201 includes a rotational shaft 201*a* and a fin 201*b* spirally formed on the peripheral surface of the rotational shaft 201*a*. Further, the transport mixer 202 includes a rotational shaft 202*a* and a paddle (first fin) 202*c* formed in plural at predetermined intervals in the circumferential direction on the peripheral surface of the rotational shaft 202*a*, and a fin 202*b* (second fin) spirally formed in a part in which the paddle 202*c* is not formed on the peripheral surface of the rotational shaft 202*a*. The parts of the fins 201*b* and 202*b* of the transport mixers 201 and 202 perform stirring and transport of the developer. Since the paddle 202*c* of the transport mixer 202 performs stirring of the developer but has no action of active transport, in the developer transport direction (the shaft direction of the rotational shaft 202), the developer transport speed in the region of the paddle 202*c* is slower than the developer transport speed in the region of the fin 202*b*. Accordingly, the bulk of developer in the paddle 202*c* part of the transport mixer 202 can be increased.

The density sensor 203 is provided at the bottom portion 106*a* of the developing apparatus 106, which faces the paddle 202*c* of the transport mixer 202, and detects toner ratio density within the developer. Since the density sensor 203 is provided in a position facing the paddle 202*c*, the toner ratio density can be accurately detected because of the developer the bulk of which has been increased by the paddle 202*c*.

The partition plate 204 stands from the bottom portion 106*a* of the developing apparatus 106 to a predetermined height position, and partitions between the transport mixers 201 and 202 except both ends in the developer transport direction. At the upper part of the partition plate 204, a notch portion (retracting means) 204*a* is formed in the same position as the position where the paddle 202*c* of the transport mixer 202 is located, and, when the amount of the developer deposited in this part becomes equal to or more than a predetermined amount from which the density sensor 203 can accurately detect the toner ratio density, the developer in the amount exceeding the predetermined amount is retracted by the notch portion 204*a* into space (here, space at the transport mixer 201 side) other than the space for detecting the toner density by the density sensor 203 (retracting step). As described above, the density sensor 203 detects the toner density of the developer that is maintained in the predetermined amount in the vicinity of the toner density detection position by the retracting step (toner density detecting step).

Thereby, the developer at the notch portion 204*a* part can maintain adequate bulk density from which the density sensor 203 can accurately detect the toner ratio density on a steady basis.

Figure 7:
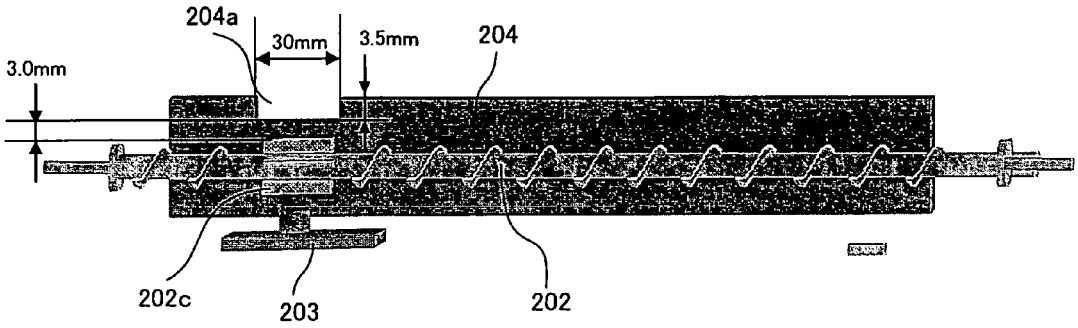
FIG. 7 shows an example indicating specific dimensions of the partition plate of the first embodiment.

As an example, as shown in FIG. 7, the notch portion 204*a* may be formed in a size of 30 mm in width, 3.5 mm in depth, 3.0 mm in distance from the upper end of the paddle 202*c*, however, it is appropriately changed into an optimum size depending on the sizes of the developing apparatus, transport mixers, and partition plate. Note that, the lower end of the notch portion 204*a* is set to the position higher than the highest point that the outer end of the rotational radius of the paddle 202*c* reaches at the time of rotation.

In the first embodiment, a configuration in which the space above the partition plate 204 except the notch portion 204*a* is closed by the ceiling portion of the developing apparatus 106 and the upper end of the partition plate 204 may be adopted.

Next, the action of the first embodiment will be described. When the developer transported by the transport mixers 201 and 202 is transported to the paddle 202*c* part of the transport mixer 202, because the paddle 202*c* has no action of active transport of the developer as described above, the developer is accumulated while being stirred by the paddle 202*c*. However, since the developer deposited higher than the notch portion 204*a* of the partition plate 204 is transported to the transport mixer 201 side through the notch portion 204*a*, the collecting developer is not excessively compressed and the developer deposited on the density sensor 203 becomes to have bulk density from which the density sensor 203 can accurately detect the toner ratio density.

Figure 8:
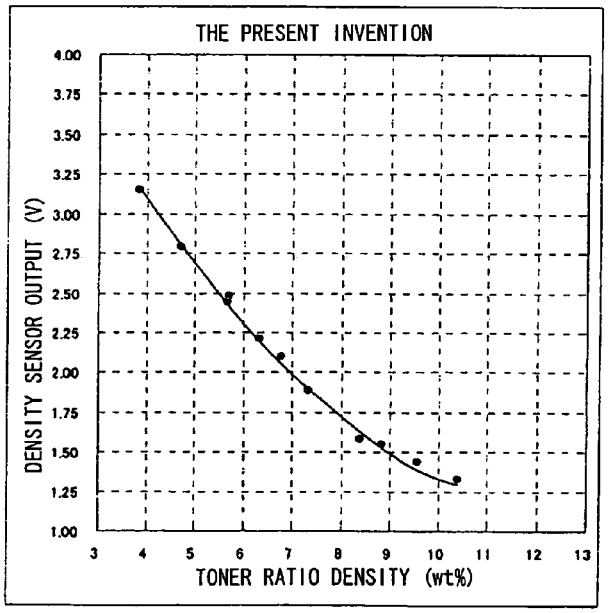
FIG. 8 is a graph showing an output of the density sensor of the developing apparatus by which the invention is implemented.

Therefore, as shown in FIG. 8, even when the toner ratio density becomes high, no phenomenon that the output of the density sensor 203 is reversed occurs, and stable output can be obtained. Further, since the notch portion 204*a* is formed only in the position where the density sensor 203 is located, the replenished fresh toner is sufficiently mixed in the developer, and image smudges in conventional technologies are never produced.

Second Embodiment

Figure 9:
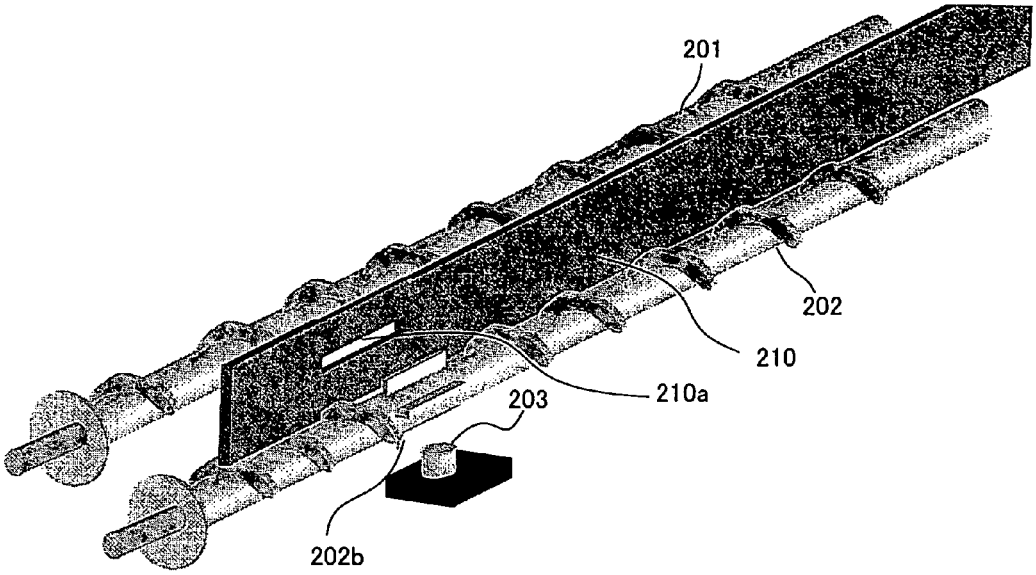
FIG. 9 is a perspective view showing the part of transport mixers, a partition plate, and a density sensor of the second embodiment.
Figure 10:
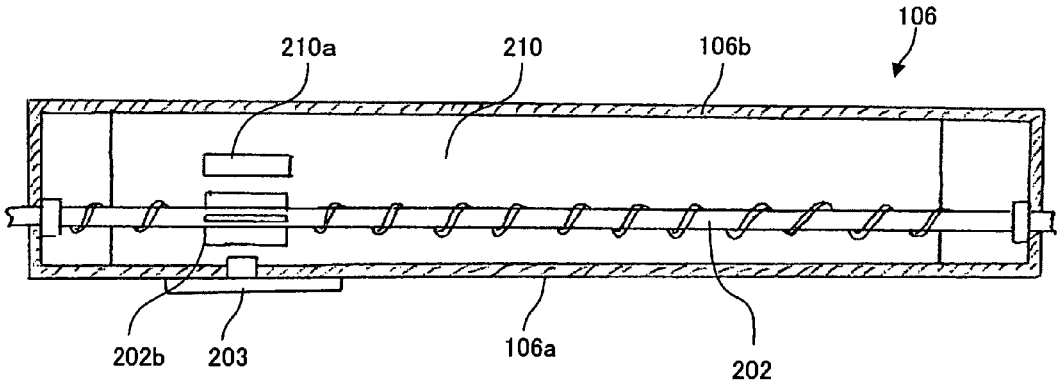
FIG. 10 is a sectional view showing the interior of a developing apparatus of the second embodiment at the side where the density sensor is provided.

Next, the second embodiment of the developing apparatus 106 will be described based on FIGS. 9 and 10. FIG. 9 is a perspective view showing the part of transport mixers 201 and 202, a partition plate 210, and a density sensor 203 of the development apparatus 106 of the second embodiment, and FIG. 10 is a sectional view of the developing apparatus 106 of the second embodiment at the side where the density sensor 203 is provided. Since other configuration and operation and effect of the developing apparatus 106 than those as below are the same as those of the first embodiment, the description of the parts overlapping between the first and second embodiments will be omitted.

The partition plate 210 is provided to close adjacent space from the bottom portion 106*a* to the ceiling portion 106*b* of the developing apparatus 106 except both end regions in the longitudinal direction of the transport mixers 201 and 202, and a through hole (retracting means) 210*a* is formed in a position in the way of the partition plate 210 along the vertical direction. The through hole 210*a* has the same action as the notch portion 204*a* of the first embodiment, and, when the amount of the developer deposited in this part becomes equal to or more than the amount from which the density sensor 203 can accurately detect the toner ratio density, the developer can be transported to the transport mixer 201 side through the through hole 210*a*.

Third Embodiment

Figure 11A:
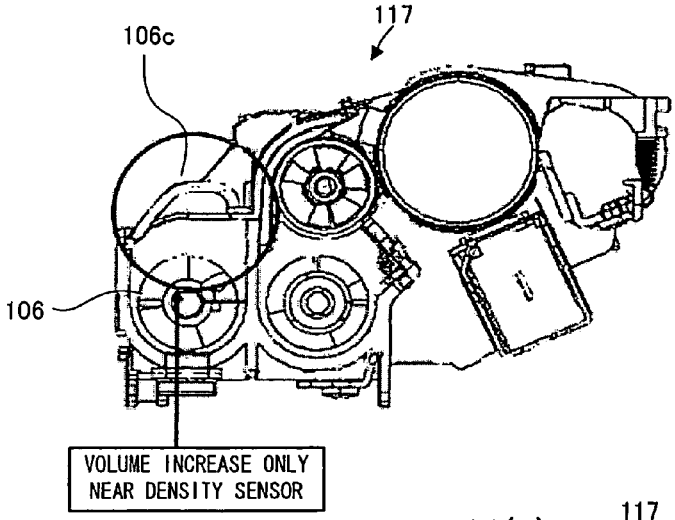
FIG. 11(*a*) is a sectional view of a process cartridge at the side where the density sensor is provided.
Figure 11B:
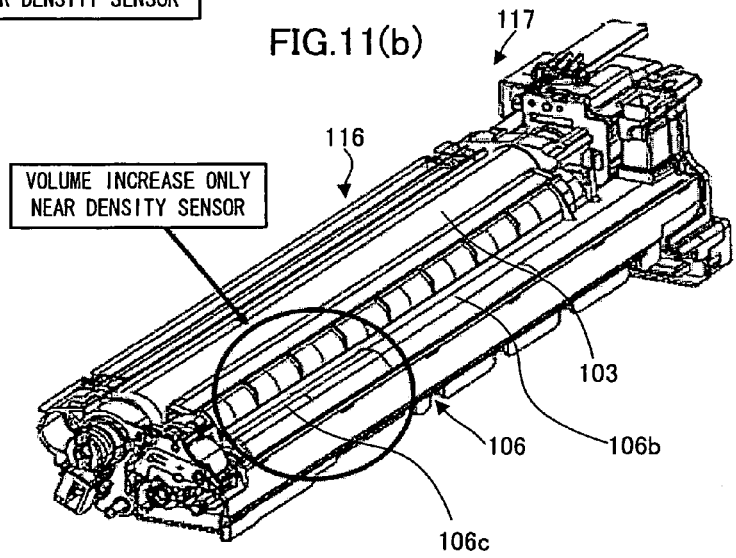
Figure 12:
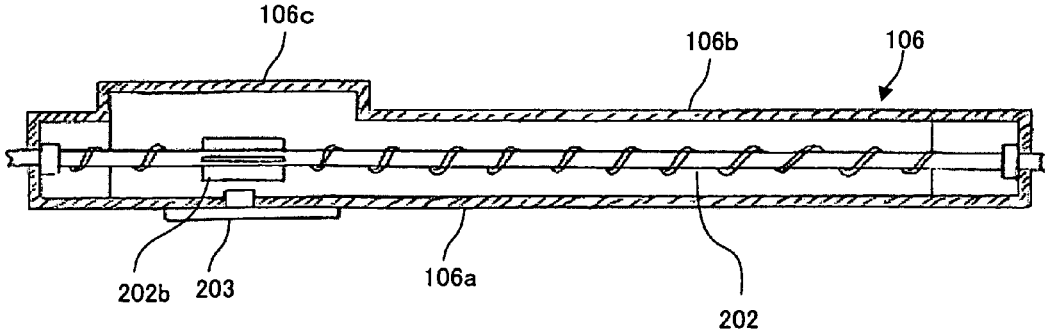
FIG. 12 is a sectional view showing the interior of a developing apparatus of the third embodiment at the side where a density sensor is provided.
Figure 13:
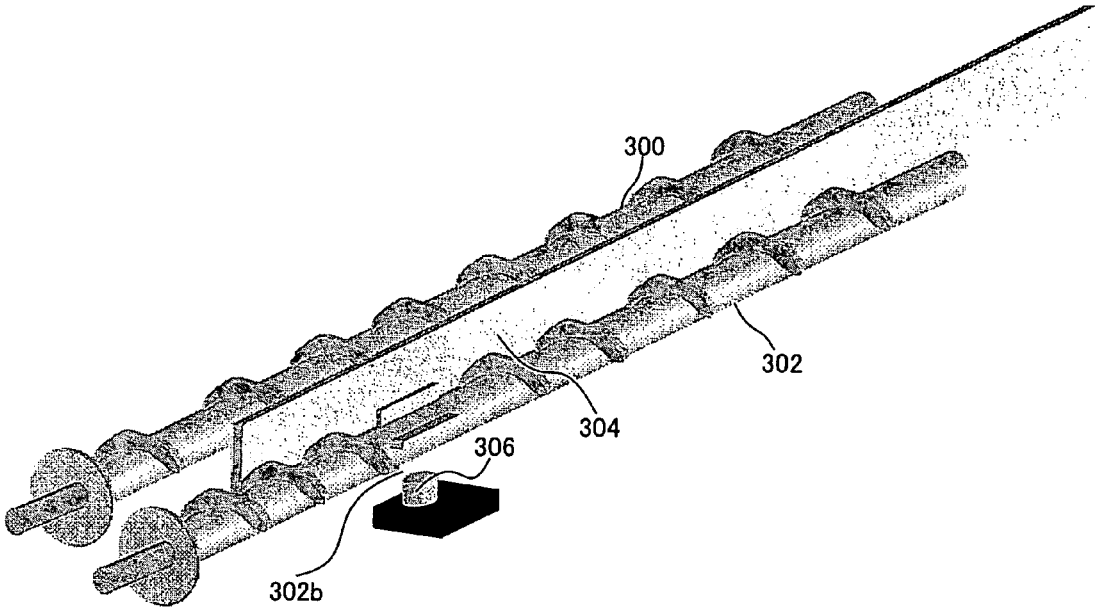
FIG. 13 is a perspective view of the part of conventional transport mixers, partition plate, and density sensor.
Figure 14:
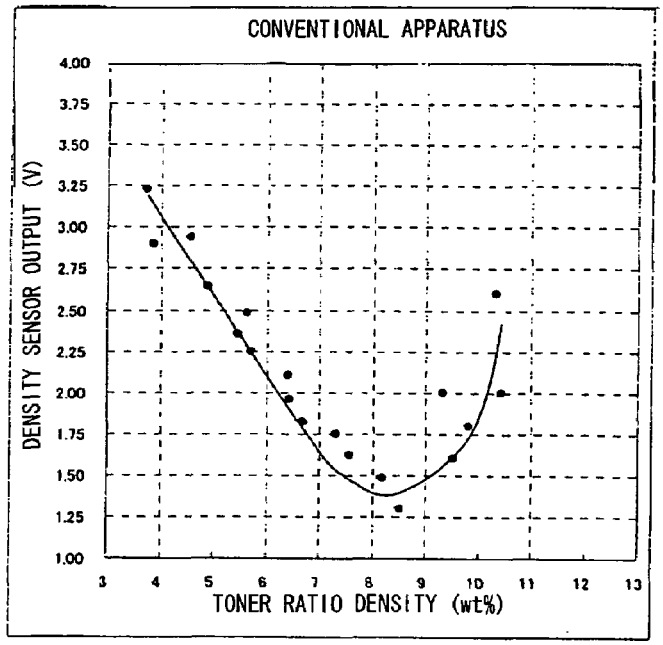
FIG. 14 is a graph showing an output of the density sensor in a conventional developing apparatus.
Figure 15:
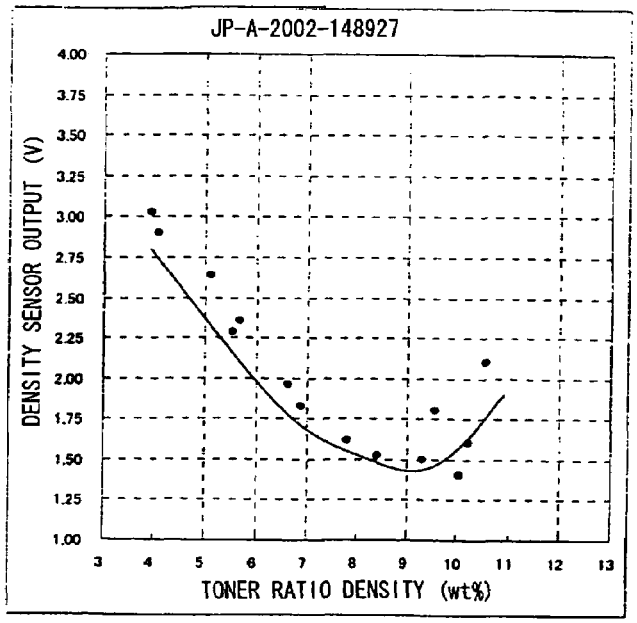
FIG. 15 is a graph showing an output of the density sensor in another conventional developing apparatus.

Next, the third embodiment of the developing apparatus 106 will be described based on FIGS. 11 and 12. FIG. 11(*a*) is a sectional view of a process cartridge 117 at the part where a density sensor 203 is provided, FIG. 11(*b*) is a perspective view of the process cartridge 117, and FIG. 12 is a sectional view of the density sensor 203 seen from the transport mixer 202 side. Since other configuration and operation and effect of the developing apparatus 106 than those as below are the same as those of the first embodiment, the description of the parts overlapping between the first and third embodiments will be omitted.

In the developing apparatus 106, a projecting portion (retracting means) 106*c* by which the height position of the ceiling portion 106*b* only in the neighborhood including the density sensor 203 is higher than the height position of the other ceiling portion 106*b* part is formed, and thereby, the internal volume is larger only in the neighborhood including the density sensor 203 than the other part. A partition plate 212 is provided to close adjacent space from the bottom portion 106*a* to the ceiling portion 106*b* and the projecting portion 106*c* of the developing apparatus 106 except both ends of the transport mixer 202.

The developer transported and deposited in the part of the density sensor 203 is never compressed or the bulk density of the developer never becomes so high that the toner ratio density detection output of the density sensor 203 is reversed because the volume of this part is larger than the other part. Accordingly, the output of the density sensor 203 is as shown in FIG. 8, and the toner ratio density can be accurately detected even when it becomes higher. Thus, the other space into which the developer more than the predetermined amount is retracted than the space for detecting the toner density by the density sensor 203 is not necessarily the space partitioned by the partition plate, but both may be connected as long as space provided in a position different from the space in which the developer for detecting the toner density must exist.

Note that the shape of the ceiling portion 106*b* of the developing apparatus 106 of the third embodiment may be applied to the above first embodiment and second embodiment, and the projecting portion 106*c* may be provided in the ceiling portion 106*b* in the position where there is the notch portion 204*a* or the through hole 210*a*.

As described above, according to the embodiments, since the bulk density of the developer at the part of the density sensor never become extremely high and the bulk density of the developer suitable for detection of the toner ratio density by the density sensor can be constantly maintained, the toner ratio density can be accurately detected.

What is claimed is:

1. A developing apparatus comprising:

a partition member provided within the developing apparatus for partitioning an interior of the developing apparatus into a plurality of space;

a transport member each provided in the space within the developing apparatus partitioned by the partition member and rotating for stirring and transporting a developer including toner and carrier;

a density detector provided in a transport path of the developer in one space of the plurality of space partitioned by the partition member for detecting density of the stirred and transported developer; and a retraction part that retracts an amount of the developer more than a predetermined amount into another space than the space in which the density is detected by the density detector so that the amount of developer is constantly equal to or less than the predetermined amount near a density detection position by the density detector.

2. An image forming apparatus comprising:

a charging unit that charges an image carrier;

an electrostatic latent image forming unit that forms an electrostatic latent image on the image carrier;

a developing apparatus according to claim 1 that supplies a developer to the electrostatic latent image;

a transfer unit that transfers a developer image developed by the developing apparatus onto paper; and a fixing unit for fixing the developer image to the paper.

3. An image forming apparatus according to claim 2, wherein a process cartridge including the image carrier and at least one of the charging unit, the developing apparatus, and a cleaner that collects the developer attached to the image carrier is detachably provided.

4. A developing apparatus according to claim 1, wherein the retraction part is provided in a position overlapping at least part of the density detector in a transport direction of the developer in the space in which the density is detected by the density detector.

5. A developing apparatus according to claim 1, wherein the transport member includes a rotational shaft and a first fin formed in plural at predetermined intervals in a circumferential direction on a peripheral surface of the rotational shaft, and a second fin spirally formed in a part in which the first fin is not formed on the peripheral surface of the rotational shaft, and the first fin is provided in a part of the rotational shaft facing to a position where the density detector is provided.

6. A developing apparatus according to claim 5, wherein the retraction part is provided in a position higher than the highest point that the outer end of the rotational radius of the first fin reaches at the time of rotation.

7. A developing apparatus according to claim 1, wherein the retraction part is a notch portion formed at an upper part of the partition member standing from a bottom portion of the developing apparatus to a predetermined height position.

8. A developing apparatus according to claim 7, wherein space adjacent each other except the notch portion is closed by a ceiling member closing an upper part of the developing apparatus and an upper end of the partition member.

9. A developing apparatus according to claim 1, wherein the retraction part is a through hole formed in a position in the way of the partition plate along a vertical direction, the partition plate closing adjacent space from a bottom portion to a ceiling portion of the developing apparatus.

10. A developing apparatus comprising:

a partition member provided within the developing apparatus for partitioning an interior of the developing apparatus into a plurality of space;

a transport member each provided in the space within the developing apparatus partitioned by the partition member and rotating for stirring and transporting a developer including toner and carrier;

a density detector provided in a transport path of the developer in one space of the plurality of space partitioned by the partition member for detecting density of the stirred and transported developer; and a retraction part being a space part as retraction space provided in a position overlapping at least part of the density detector in a transport direction of the developer in the space in which the density is detected by the density detector and having larger volume than the other part.

11. An image forming apparatus comprising:

a charging unit that charges an image carrier;

an electrostatic latent image forming unit for forming an electrostatic latent image on the image carrier;

a developing apparatus according to claim 10 for supplying a developer to the electrostatic latent image;

a transfer unit for transferring a developer image developed by the developing apparatus onto paper; and a fixing unit for fixing the developer image to the paper.

12. A developing apparatus comprising:

a partitioner that partitions an interior of the developing apparatus into a plurality of space;

a transporter that stirs and transports a developer including toner and carrier in the space;

a density detector that detects density of the developer in one space of the plurality of space; and a retractor that retracts an amount of the developer more than a predetermined amount into another space than the space in which the density is detected by the density detector so that the amount of developer is constantly equal to or less than the predetermined amount near a density detection position by the density detector.

13. An image forming apparatus comprising:

charger that charges an image carrier;

electrostatic latent image former that forms an electrostatic latent image on the image carrier;

a developing apparatus according to claim 12 for supplying a developer to the electrostatic latent image;

a transferer that transfers a developer image developed by the developing apparatus onto paper; and a fixer that fixes the developer image to the paper.

14. A developing apparatus comprising:

partitioner that partitions an interior of the developing apparatus into a plurality of space;

transporter that stirs and transports a developer including toner and carrier in the space;

density detector that detects density of the developer in one space of the plurality of space; and a retractor being a space part as retraction space provided in a position overlapping at least part of the density detector in a transport direction of the developer in the space in which the density is detected by the density detector and having larger volume than the other part.

15. An image forming apparatus comprising:

a charger that charges an image carrier;

electrostatic latent image former that forms an electrostatic latent image on the image carrier;

a developing apparatus according to claim 14 for supplying a developer to the electrostatic latent image;

a transferer that transfers a developer image developed by the developing apparatus onto paper; and a fixer that fixes the developer image to the paper.

16. A density detection method that stirs and transports a developer including toner and carrier by rotation of plural transport members respectively provided in a plurality of space formed by partitioning an interior of a developing apparatus with a partition member and detecting density of the stirred and transported developer by a density detector, the method comprising:

a transporting step that transports the developer at least in one space of the plurality of space partitioned by the partition member;

a retracting step that retracts an amount of the developer more than a predetermined amount into another space than the space in which the density is detected by the density detector so that the amount of developer is constantly equal to or less than the predetermined amount near a density detection position by the density detector; and a toner density detecting step that detects the density of the developer maintained in the predetermined amount near a density detection position by the retracting step.

17. A density detection method according to claim 16, wherein the developer is retracted via a notch formed at an upper part of the partition member standing from a bottom portion of the developing apparatus to a predetermined height position.

18. A density detection method according to claim 16, wherein the developer is retracted via a through hole formed in a position in the way of the partition plate along a vertical direction, the partition plate closing adjacent space from a bottom portion to a ceiling portion of the developing apparatus.

19. A density detection method that stirs and transports a developer including toner and carrier by rotation of plural transport members respectively provided in a plurality of space formed by partitioning an interior of a developing apparatus with a partition member and detecting density of the stirred and transported developer, the method comprising:

a transporting step that transports the developer at least in one space of the plurality of space partitioned by the partition member;

a retracting step that retracts the developer into a space part as retraction space provided in a position overlapping at least part of the density detector in a transport direction of the developer in the space in which the density is detected by the density detector and having larger volume than the other part; and a toner density detecting step that detects the density of the developer maintained in the predetermined amount near a density detection position by the retracting step.

* * * * *